United States Patent [19]

Roesner

[11] 4,351,863

[45] Sep. 28, 1982

[54] PAINT SPRAYING ASSEMBLY

[75] Inventor: Keith G. Roesner, Kewanee, Ill.

[73] Assignee: Deere & Company, Moline, Ill.

[21] Appl. No.: 203,861

[22] Filed: Nov. 4, 1980

Related U.S. Application Data

[62] Division of Ser. No. 65,446, Aug. 10, 1979, Pat. No. 4,266,504.

[51] Int. Cl.[3] ..... B05D 1/02

[52] U.S. Cl. ..... 427/421; 427/424; 98/115 SB

[58] Field of Search ..... 118/314, 326, DIG. 7, 118/663, 634, 712; 427/375, 345, 421, 424; 98/115 SB

[56] References Cited

U.S. PATENT DOCUMENTS

| | | | |
|---|---|---|---|
| 3,395,972 | 8/1968 | Hardison | 118/326 X |
| 3,424,129 | 1/1969 | Peeps et al. | 118/326 X |
| 4,237,780 | 12/1980 | Truhan | 98/115 SB |

FOREIGN PATENT DOCUMENTS

| | | | |
|---|---|---|---|
| 52-9961 | 1/1977 | Japan . | |
| 669155 | 6/1979 | U.S.S.R. | 98/115 SB |

*Primary Examiner*—Shrive P. Beck

[57] ABSTRACT

A paint spraying assembly that includes a fan and duct work recirculating air through a spraying booth; a blower having an inlet to said recirculating air for drawing a part of the recirculating air and replacing the part with clean make-up air, the blower having a connection into the gas source for a burner used in heating water in an associated washer whereby said burner will burn off the solvent contained in the air drawn from the recirculating air, and a method of maintaining safe painting conditions in a paint spraying booth comprising the steps of continuously recirculating air through the booth at a relatively high volumetric rate; drawing off a quantity of the solvent-laden recirculating air and replacing it with clean air sufficient to maintain the recirculating air at a safe Lower Explosion Level; burning the solvent from the drawn solvent-laden air prior to it moving through an exhaust; and pressurizing with clean air the area of the external respiratory orifices of a human in the booth.

10 Claims, 1 Drawing Figure

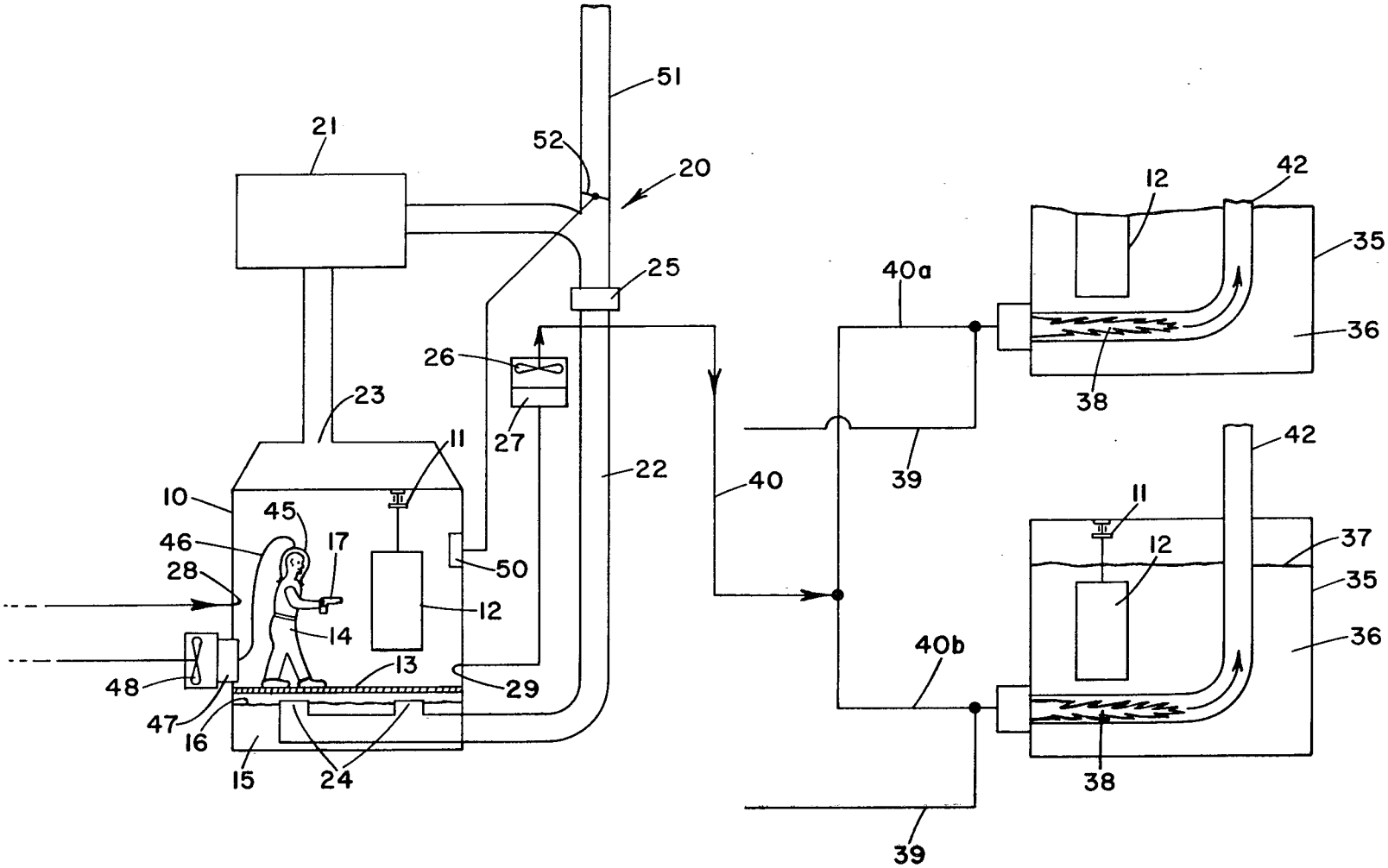
35
36
42
12
38
37
35
36
42
11
12
38
40a
39
40b
39
40
51
20
25
22
52
27
26
50
12
29
11
13
23
21
17
14
24
45
15
10
46
28
16
47
48

PAINT SPRAYING ASSEMBLY

This is a division of application Ser. No. 065,446, filed Aug. 10, 1979, now U.S. Pat. No. 4,266,504.

BACKGROUND OF THE INVENTION

One of the more conventional types of paint spraying systems incorporates a painting booth or room through which articles to be painted are moved by a conveyor. A human operator stands close to the articles with a paint spraying unit and sprays the articles as they move adjacent to him. The booth has an open floor so that particles of paint not landing on the article may pass through the floor to a lower liquid where they are collected, either to be reused or to be disposed of. In order to protect the operator that is spraying the articles, there is provided an air system having very large volumetric capacity which moves air across the area where the operator is standing and prevents paint particles and solvent from remaining in the area. Normally, the operator is provided with a small filter mask that prevents incidental paint particles from entering his lungs and respiratory system. Generally, the amount of air passing through the area is controlled by government regulations or through normal standards of safety. Solvent-laden air leaving the booth is moved to exhaust chimneys which discharge the air and its solvents externally of the building containing the booth.

Associated with paint spraying units are immersion-type washer units through which the articles to be painted are immersed and cleansed prior to their reaching the painting booth. This is done for the purpose of removing oil and other foreign matter from the surfaces of the respective articles, thereby insuring uniform painting. Normally, the liquid contained in the washer or immersion tank is heated, conventionally by oil or gas burners. Exhaust from the burners is discharged through conventional stacks to the atmosphere. The exhaust from the burners is relatively clean and there is normally no objection to this type of exhaust.

One of the problems with the above described type of paint spraying systems is that the air moving through the paint booth that is exhausted externally of the building becomes solvent-laden and particle-laden and creates environmental problems. As the governmental environmental restrictions become more strict, it is possible that in the future such emission of the solvent-laden air will be prohibited in its entirety. Even today, the type and quality of such discharge requires considerable filtering and cleaning.

A second problem that is created by this system of paint spraying is that there is required a large volume of air that must continuously move past the human operator spraying the articles. Not only does this require energy for moving the air, but it necessitates a tremendous amount of energy for heating the air prior to its passing adjacent the operator. This is a problem particularly in northern areas and particularly during the colder weather when all air taken from the outside must be heated. In some instances there is required as much as 80,000 cfm of air for each human in the spraying booth. In such instances, the energy used to heat this air may far exceed all other costs in the spraying operation.

SUMMARY OF THE INVENTION

With the above in mind, it is the primary object of the present invention to provide a low-cost spraying system affording comfort and safety for the operator. It is proposed to recirculate the solvent-laden air through the booth and to draw off a part of the air so that clean air replacing the drawn-off air will maintain the booth at a safe LEL (Lower Explosion Level). The drawn-off solvent-laden air is then moved through the burners with the mixture of natural gas or oil. The burners burn off the solvent from this drawn-off air and the discharge residue is moved through the regular exhaust stacks for the burners. In order to provide safety for the operators from the recirculating solvent-laden air, each operator is provided with a pressurized hood covering the head portion of his body. The hood is provided with clean air at an internal pressure greater than the external pressure of the solvent-laden air. This prevents the solvents and other spray particles from moving into the respiratory orifices of the human operator.

With such an arrangement, the tremendous energy which is normally required in the more conventional systems referred to above is reduced since the recirculated air will remain at room temperature. The only solvent-laden air that moves out of the booth is that which is drawn off for purposes of maintaining a low LEL and the solvents in this air are further utilized to help warm the liquid in the washer tanks. As a result, there is practically no undesirable exhaust passed to the outside of the building and into the atmosphere.

A further object of the invention is to provide a method of maintaining safe painting conditions in a paint spraying booth and reducing the contaminants from the exhaust by recirculating the solvent-laden air through the painting booth at a relatively high volumetric rate, providing an outside source of clean air to the solvent-laden air and drawing off a relatively small quantity of the solvent-laden air so that the clean air maintains the air moving through the booth at a low LEL. The method further includes the step of burning the solvents from the air that are drawn off prior to its being exhausted from the system and the further step of pressurizing the area of the external respiratory orifices of the human spraying the articles in the booth.

BRIEF DESCRIPTION OF THE DRAWING

The FIGURE is a schematic view of a paint spraying system utilizing the principles of the present invention.

DESCRIPTION OF THE PREFERRED EMBODIMENT

Referring now to the drawing, a paint spraying booth 10 is provided with an overhead conveyor 11 on which are carried articles to be painted, such articles being indicated by the reference numeral 12. Contained in the booth 10 is a perforated floor 13 on which stands a human sprayer operator 14. The floor 13 is above water 15 with an upper surface 16 spaced slightly under the floor. The operator carries a spray unit indicated by the reference numeral 17 that sprays the articles 12 as they move along the conveying section 11.

Air is circulated through the booth 10 by means of a fan and duct works indicated in its entirety by the reference numeral 20, the fan being indicated by the reference numeral 21 and the duct work being indicated by the reference numeral 20. The duct work 20 has a booth inlet 23 at the top of the booth and a pair of outlets 24 that open at the surface 16 of the water 15. As is conventional, as paint leaves the spray gun 17, paint particles will pass through the floor 13 onto the surface 16 of the water 15. The particles of paint will be recaptured from the water in a manner that is conventional in spraying equipment. The air and paint solvents contained in the air will pass through the outlets 24 and continue into duct 22. A filter and a manometer 25 are provided in the duct work for filtering the remaining particles of paint as well as measuring the pressure of the solvent-laden air in the duct work. Air passing through the booth as it is recirculated by means of the fan and ducts 20 continuously picks up additional paint solvents as it passes near the operator 14 in the booth.

In order to maintain safe conditions for the operator 14 in the paint booth, there is first provided a system for bleeding off a portion of the recirculated air moving through the fan and duct work 20 so as to maintain the solvent-laden air at an LEL (Lower Explosive Level) which will be sufficiently low to maintain safety from explosion and/or fire within the booth 10. Also, in order to maintain safety for the operator 14 with respect to the solvents in the air, a pressurized hood is provided for him, details of which will be explained in a subsequent part of this specification. In order to maintain the recirculated air through the blower 21 and duct work 20 at a desired 25% LEL or lower, there is provided an auxiliary blower 26 having a filter 27 associated therewith that draws clean air into the booth 10 from an outside source through an air inlet 28. The blower 27 has an inlet 29 that is in communication with the recirculated air. In the particular form of the invention shown, it is in communication with the recirculated air within the booth 10. However, the blower 26 could have an inlet to any part of the duct work 20. Although it may vary from one paint system to another, the present system contemplates, for example, that the fan 21 will move or recirculate air at a rate of 80,000 cfm and the blower 27 will move clean or make-up air through the inlet 28 at a rate of 1200 cfm. It is believed that under normal conditions, this will be sufficient to maintain the 25% or lower LEL condition in the booth 10.

Associated with the paint booth 10 are cleaning tanks 35, each having a section of the conveyor 11 moving through it. Contained in the tank or container 35 is a cleaning liquid 36 having an upper surface 37. The conveyor 11 carrying the articles 12 submerges the articles in the cleaning fluid. The cleaning fluid 36 cleans off oil deposits and foreign matter from the articles 12 prior to their entering into the paint booth 10. It has been found that warm liquids 36 clean the articles 12 in a better manner than if the liquid is cold. Therefore, in the tanks or containers 35 there are burners 38 of general conventional nature that heat the liquid. Natural gas moving through lines 39 is provided for each of the burners 38. As a suplement to the natural gas 39, the solvent-laden air moving through the blower 27 and through a discharge line 40 is introduced into the natural gas moving through the lines 39 just prior to its moving through the burners 38. Thus, the solvent-laden air seems to at least partially fuel the burners 38. The discharge line 40 is divided into lines 40A, 40B in their area of connection to the respective natural gas lines 39. Since there is 1200 cfm of solvent-laden air moving through the line 40, such is divided into 600 cfm of air in the respective lines 40A, 40B. Each burner 38 is provided with an exhaust tube 42 vented to the atmosphere. Consequently, the solvent-laden air that moves through the line 40 and the lines 40A, 40B has the hydrocarbons of the solvent oxidized or burned off in the burners 38. The remaining residue of air as it moves into the atmosphere from the ducts 42 is relatively safe and is generally acceptable from an environment standpoint.

A hood 45 is provided for the human operator 14. The hood 45 is of the type that completely covers the respiratory orifices of the operator 14 and has an air line 46 that extends from a filter 47, where it is both tempered and filtered, and a blower or fan 48 that moves the air through the filter 47 and into the hood 45. The air may be taken from the room outside of the booth 10 or it may be taken from outside air, whichever is desired. It should be understood that the air within the hood 45 is maintained at a higher pressure than the pressure of the recirculated air moving through the booth 10. As a consequence, none of the recirculating air enters into the respiratory system of the operator. The operator 14 is in comparable comfort as he paints within the booth 10. He is also safe from any problems due to the solvents in the paint and because of the bleeding off constantly of a portion of the recirculating air, and its replacement by clean air so that the air within the booth is maintained at a 25% or lower LEL. The solvents in the recirculating air will not cause any discomfort or danger due to the pressurized hood 45 carried over the respiratory areas of the operator 14.

While the air moving through the duct work 20 will normally recirculate, there is provided an additional safety feature which will open the air to the atmosphere should the recirculated air become dangerous for any reason. A monitor 50 is mounted on the wall of the booth 10 and monitors the air within the booth. An outside exhaust pipe 51 is provided to connect to the duct work 20. Should the monitor 50 sense a condition in which the LEL is above 26%, it will affect the opening of a valve or damper 52 in the exhaust duct 51 which will permit and cause the recirculated air to move through the exhaust duct 51 rather than to be recirculated through the booth 10. Since the fan 21 moves a high volume of air through the booth 10, it will be momentary that the air within the booth is reduced to the 25% or lower LEL. Upon the sensing device 50 sensing that the proper LEL exists in the booth 10, it will close the damper 52.

While it should be recognized that sizes of paint booths 10 will require different amounts of air to be circulated and also that the rate of circulation as well as the sizes of the booth will determine the amount of recirculated air required to be removed from the system and replaced with clean make-up air in order to maintain the proper LEL, it is to be understood that the present specific details were described for the purposes of indicating the method under which the present system is used as well as the structure that affects the system.

The spraying assembly, as well as the method of maintaining safe conditions for a human operator in the spray booth 10 operates as follows. As the sprayer 14 sprays the articles 12, both solvents and other contaminants will move into the booth 10. The fan 21 will cause the solvents and some contaminants to move through the duct work 20 and to again be recirculated through the booth. In order to prevent danger to the operator 14, sufficient air is bled from the recirculating air by the blower 27 so that the air within the booth is retained at or below a desired LEL. The air that is bled off from the booth is then moved into the burners where the burners for the washers are used to burn natural gas as well as the volatile solvents that have been bled off with the recirculating air. This burnt off air is then moved to proper exhaust tubes into the outside atmosphere. The operator 14 is protected by a pressurized hood that fits over the respiratory areas of the sprayer. This will prevent the human sprayer 14 from breathing portions of the somewhat contaminated recirculated air.

I claim:

1. A method of maintaining safe painting conditions in a paint spraying booth for a human spraying articles therein and for reducing the contaminants moving through an exhaust therefrom, comprising the steps of: recirculating air through the booth at a relatively high volumetric rate as articles are being sprayed by a human; removing substantially all the paint particles from the air leaving the booth as it is recirculated; drawing off a quantity of the recirculating air at a comparatively low volumetric rate and replacing it with clean air sufficient to maintain the recirculating air at a safe LEL, but at a solvent contaminant level unsatisfactory for breathing; burning the solvent from the drawn air prior to its moving through the exhaust; and placing a pressurized hood supplying clean air to the external respiratory orifices of the human in the booth so as to protect the human from paint contaminate in the recirculated air.

2. The method described in claim 1 further characterized by the steps of sensing the amount of solvent in the recirculating air; and opening dampers to externally exhaust the recirculating air upon the mixture of solvent and air reaching a predetermined LEL.

3. A method of maintaining safe painting conditions in a paint spraying booth for a human spraying articles therein, comprising the steps of: continuously recirculating air laden with paint contaminants through the booth at a relatively high volumetric rate as articles are being sprayed by a human; removing substantially all the paint particles from the recirculating air leaving the booth, drawing off a quantity of the recirculating air and replacing it with clean air at a comparatively low volumetric rate to maintain the solvent-air-ratio in the recirculating air at a safe LEL, but at a level unsatisfactory for breathing by a human; and placing a pressurized hood being fed clean air over the area of the external respiratory orifices of a human in the booth so as to protect the human from the solvent contaminates in the recirculated air.

4. The method described in claim 3 further characterized by the step of burning off the solvent in the air drawn from the recirculating air and having the residue thereof exhaust to the atmosphere.

5. The method described in claim 4 further characterized by utilizing the heat generated by the solvent that is burned off to warm fluid used in the paint system.

6. A method of maintaining safe painting conditions in a paint spraying booth for a human spraying articles therein, comprising the steps of: continuously recirculating air laden with the paint contaminates through the booth at a relatively high volumetric rate as articles are being sprayed by a human; removing substantially all the paint particles from the recirculating air leaving the booth; drawing off a quantity of the recirculating air and replacing it with clean air at a comparatively low volumetric rate to maintain the solvent-air-ratio in the recirculating air at a safe LEL, but at a contaminate level unsatisfactory for breathing by a human; constantly monitoring the solvent-air-ratio in the recirculating air and automatically and instantaneously discharging the recirculating air through an exhaust in response to said ratio exceeding said safe LEL; burning the solvent from the drawn air prior to its moving through an exhaust; and placing a pressurized hood being fed clean air over over the area of the external respiratory orifices of a human in the booth.

7. A method of maintaining safe painting conditions in a paint spraying booth for a human spraying articles therein, comprising the steps of: recirculating air continuously through the booth at a relatively high volumetric rate as articles are being sprayed by a human; removing substantially all the paint particles from the recirculating air moving from the booth; drawing off a quantity of the recirculating air at a relatively low volumetric rate and replacing it with clean air sufficient to maintain the recirculating air at a safe LEL, but at a solvent contaminate level unsatisfactory for breathing; and placing a pressurized hood supplied with clean air over the head of said human in the booth so that the clean air of the pressurized hood moves from internal to external of the hood.

8. The method defined in claim 6 further characterized by the steps of treating the drawn air so as to eliminate the solvent therefrom and thereafter, exhausting such air into the atmosphere.

9. The method defined in claim 7 in which the drawn air is treated by burning the solvent therefrom.

10. The method defined in claim 6 further characterized by the steps of constantly monitoring the LEL of the recirculating air in the booth and automatically and instantaneously exhausting such air to the atmosphere upon the LEL exceeding the safe LEL.

* * * * *